US010418736B2

(12) United States Patent
Sunaga et al.

(10) Patent No.: US 10,418,736 B2
(45) Date of Patent: Sep. 17, 2019

(54) METAL PLATE FOR TERMINAL, TERMINAL, AND TERMINAL PAIR

(71) Applicants: AUTONETWORKS TECHNOLOGIES, LTD., Yokkaichi-shi, Mie (JP); SUMITOMO WIRING SYSTEMS, LTD., Yokkaichi-shi, Mie (JP); SUMITOMO ELECTRIC INDUSTRIES, LTD., Osaka-shi, Osaka (JP)

(72) Inventors: Takahiro Sunaga, Yokkaichi (JP); Akihiro Kato, Yokkaichi (JP)

(73) Assignees: AUTONETWORKS TECHNOLOGIES, LTD., Yokkaichi, Mie (JP); SUMITOMO ELECTRIC INDUSTRIES, LTD., Yokkaichi, Mie (JP); SUMITOMO WIRING SYSTEMS, LTD., Osaka-Shi, Osaka (JP)

( * ) Notice: Subject to any disclaimer, the term of this patent is extended or adjusted under 35 U.S.C. 154(b) by 0 days.

(21) Appl. No.: 15/767,686

(22) PCT Filed: Oct. 5, 2016

(86) PCT No.: PCT/JP2016/079565
§ 371 (c)(1),
(2) Date: Apr. 12, 2018

(87) PCT Pub. No.: WO2017/068974
PCT Pub. Date: Apr. 27, 2017

(65) Prior Publication Data

US 2018/0316109 A1 Nov. 1, 2018

(30) Foreign Application Priority Data

Oct. 20, 2015 (JP) ..... 2015-206553

(51) Int. Cl.
*H01R 9/24* (2006.01)
*H01R 13/03* (2006.01)
(Continued)

(52) U.S. Cl.
CPC ..... *H01R 13/03* (2013.01); *C25D 3/46* (2013.01); *C25D 3/64* (2013.01); *C25D 5/10* (2013.01);
(Continued)

(58) Field of Classification Search
CPC ..... H01R 13/11; H01R 13/03; H01R 4/183; H01R 12/724; H01B 1/023; C25D 7/00; C25D 5/10; C25D 3/46; C25D 3/64
(Continued)

(56) References Cited

U.S. PATENT DOCUMENTS 6,575,635 B1 * 6/2003 Tsuji ..... F16C 33/124 384/276
2001/0036746 A1 * 11/2001 Sato ..... B23H 5/08 438/745
(Continued)

FOREIGN PATENT DOCUMENTS

JP 2000150039 A 5/2000

OTHER PUBLICATIONS

International Preliminary Report on Patentability for Application No. PCT/JP2016/079565 dated Feb. 21, 2017; 10 pages.
(Continued)

*Primary Examiner* — Jean F Duverne
(74) *Attorney, Agent, or Firm* — Reising Ethington, P.C.

(57) ABSTRACT

A metal plate for a terminal and a terminal in which cracks in a plating film due to bending or the like can be suppressed, and a terminal pair that is wear resistant against micro-sliding. The metal plate includes a base material and, a plating film that covers the entire surface of the base
(Continued)

material. The plating film includes an intermediate Ag layer that is layered on the base material, and an Ag—Sn alloy layer that is layered on the intermediate Ag layer and is exposed on the outermost surface. The terminal is made from the metal plate and has a protruding contact projecting from the surrounding region and is configured to come into contact with a corresponding terminal. The plating film is arranged at least on the protruding contact.

2 Claims, 5 Drawing Sheets

(51) Int. Cl.

| | |
|---|---|
| ***C25D 5/10*** | (2006.01) |
| ***C25D 5/50*** | (2006.01) |
| ***C25D 7/00*** | (2006.01) |
| ***H01R 13/11*** | (2006.01) |
| ***C25D 3/46*** | (2006.01) |
| ***C25D 3/64*** | (2006.01) |
| ***H01B 1/02*** | (2006.01) |
| *H01R 4/18* | (2006.01) |
| *H01R 12/72* | (2011.01) |

(52) U.S. Cl.
CPC ..... *C25D 5/50* (2013.01); *C25D 5/505* (2013.01); *C25D 7/00* (2013.01); *H01B 1/023* (2013.01); *H01R 13/11* (2013.01); *H01R 13/113* (2013.01); *H01R 4/183* (2013.01); *H01R 12/724* (2013.01)

(58) Field of Classification Search
USPC ..... 439/887
See application file for complete search history.

(56) References Cited

U.S. PATENT DOCUMENTS

| | | | | |
|---|---|---|---|---|
| 2005/0020052 | A1* | 1/2005 | Lee | H01L 23/3114 438/613 |
| 2011/0012497 | A1 | 1/2011 | Sumiya et al. | |
| 2015/0079422 | A1 | 3/2015 | Sunaga et al. | |

OTHER PUBLICATIONS

International Search Report for Application No. PCT/JP2016/079565 dated Nov. 22, 2016; 6 pages.

* cited by examiner

METAL PLATE FOR TERMINAL, TERMINAL, AND TERMINAL PAIR

CROSS REFERENCE TO RELATED APPLICATIONS

This application claims the priority of Japanese patent application JP2015-206553 filed on Oct. 20, 2015, the entire contents of which are incorporated herein.

TECHNICAL FIELD

The present invention relates to a metal plate for a terminal, a terminal formed of the metal plate for a terminal, and a terminal pair including the terminal.

BACKGROUND ART

With recent increased use of vehicles such as hybrid cars and electric vehicles, there is increasing demand for terminals that conduct a large current, such as terminals attached to electric wires for supplying power to motors and the like. Contacts of this sort of terminal are typically plated with Ag (silver) whose contact electrical resistance is low. When terminals are fitted to each other, Ag layers on respective contacts come into contact with each other, and the terminals are electrically connected to other.

However, since Ag is a relatively soft metal and is likely to cause adhesion, a terminal pair in which Ag layers are exposed on the surfaces of contacts is likely to be worn due to Ag adhesion. In particular, if the Ag layers slide over each other during terminal insertion or the like, wearing due to adhesion becomes apparent. If severe wearing appears, a base material whose contact electrical resistance is larger than that of an Ag layer is exposed and comes into contact with the corresponding terminal, and thus the connection reliability of the terminal pair becomes poor.

The present inventors conducted an in-depth study in order to address this problem, and developed a technique for sequentially layering a base plating made of nickel or copper, a silver-tin alloy layer, and a silver coating layer, on a base material (Patent Document 1 JP2013-231228A). In the plated member of Patent Document 1, a silver-tin alloy layer that is harder than silver is formed under a silver coating layer that is exposed on the surface, and thus the coefficient of friction during terminal insertion or the like can be lowered. As a result, the wear resistance can be improved.

SUMMARY

However, in the plated member of Patent Document 1, the base plating is made of a relatively hard metal such as Ni (nickel) or Cu (copper). Thus, depending on the thickness of the base plating, cracks may appear due to strain or impact applied when the base plating is bent. If the cracks that have appeared in the base plating spread to the upper layers or the base material, the corrosion resistance or the connection reliability may become poor.

Furthermore, the plated member of Patent Document 1 is problematic in that the contact electrical resistance is likely to increase when micro-sliding is applied thereto. In particular, when the plated members slide over each other, the contact electrical resistance increases at a relatively early stage. The reason as to why the contact electrical resistance increases due to micro-sliding is that, for example, insulating wear debris is generated, or a metal layer with low electrical resistance such as a silver coating layer or a silver-tin alloy layer disappears due to wearing.

As described above, the plated member of Patent Document 1 still has room for improvement in terms of the bendability or the wear resistance against micro-sliding.

The present design was achieved in view of the above-described background, and provides a metal plate for a terminal and a terminal in which cracks in a plating film due to bending or the like can be suppressed, and a terminal pair that is excellent in terms of wear resistance against micro-sliding.

An aspect of the present application is directed to a metal plate for a terminal, including a base material, and a plating film that covers at least part of the base material, wherein the plating film includes an intermediate Ag (silver) layer that is layered on the base material, and an Ag—Sn (silver-tin) alloy layer that is layered on the intermediate Ag layer and exposed on an outermost surface, and a thickness of the intermediate Ag layer is smaller than a thickness of the Ag—Sn alloy layer.

Another aspect of the present application is directed to a terminal made from the metal plate for a terminal according to the above-described aspect, wherein the terminal has a protruding contact that comes into contact with a corresponding terminal, and the plating film is arranged at least on the protruding contact.

Another aspect of the present application is directed to a terminal pair having the terminal according to the above-described aspect and a corresponding terminal that is fitted to the terminal, wherein the corresponding terminal has a flat plate-shaped contact that comes into contact with the contact of the terminal, and the flat plate-shaped contact has a surface Ag layer that is exposed on an outermost surface.

The metal plate for a terminal has a plating film in which the intermediate Ag layer and the Ag—Sn alloy layer are sequentially layered, on the base material. The intermediate Ag layer is relatively soft, and thus it can be easily deformed when bending the metal plate. Furthermore, when the intermediate Ag layer is deformed, strain and impact applied to the relatively hard Ag—Sn alloy layer can be alleviated. As a result, in the metal plate, cracks in the plating film due to bending or the like can be suppressed.

The terminal has a protruding contact that comes into contact with a corresponding terminal. Furthermore, the plating film is arranged at least on the protruding contact. Accordingly, cracks can be suppressed from occurring in the plating film while performing pressing or the like on the metal plate to form the protruding contact. Furthermore, in the terminal, also when the plating film is arranged at a portion other than the protruding contact, cracks can also be suppressed from occurring in the plating film during terminal formation. As a result, the terminal is excellent in terms of connection reliability and corrosion resistance.

Furthermore, the present inventors conducted an in-depth study and found that the wear resistance against micro-sliding can be improved by using the terminal in combination with the corresponding terminal. That is to say, in the terminal pair, the protruding contact having the plating film and the flat plate-shaped contact having the surface Ag layer exposed on the outermost surface thereof come into contact with each other, and thus the wear resistance against micro-sliding can be improved compared with a terminal pair formed of the above-described terminals or a terminal pair formed of conventional terminals. Accordingly, the terminal pair can maintain low contact electrical resistance for a long period of time, for example, even in environments where harsh vibrations are applied as in automobiles.

DESCRIPTION OF EMBODIMENTS

In the metal plate, the base material can be selected from various conductive metals. Specifically, preferable examples of the base material include Cu, Al (aluminum), Fe (iron), and alloys containing these metals. These metal materials are excellent not only in terms of conductivity but also in terms of formability and spring properties, and can be applied to terminals in various forms.

The plating film may cover at least part of the base material, or may cover the entire surface of the base material. When the plating film covers part of the base material, the plating film is arranged at least on the protruding contact.

The plating film has a two-layer structure including an intermediate Ag layer directly layered on the base material, and an Ag—Sn alloy layer directly layered on the intermediate Ag layer. The intermediate Ag layer is thinner than the Ag—Sn alloy layer. Thus, the load that is applied to the plating film during terminal insertion can be easily supported by the relatively hard Ag—Sn alloy layer. As a result, in the terminal, cracks in the plating film can be suppressed as described above, and an increase in the terminal insertion force can be prevented.

Furthermore, the thickness of the intermediate Ag layer is preferably 0.3 μm or more. If the thickness of the intermediate Ag layer is 0.3 μm or more, cracks in the plating film can be more effectively suppressed. From the same point of view, the thickness of the intermediate Ag layer is more preferably 0.4 μm or more, and even more preferably 0.5 μm or more.

In order to suppress cracks in the plating film, there is no specific limitation on the upper limit of the thickness of the intermediate Ag layer. However, if the thickness of the intermediate Ag layer increases, the amount of Ag used increases, and thus the material cost increases. Furthermore, if the thickness of the intermediate Ag layer is excessively large, there may be an increase in the terminal insertion force. Accordingly, in order to reduce the material cost and the terminal insertion force, the thickness of the intermediate Ag layer is preferably 5 μm or less.

The metal plate can be preferably used for a terminal that has a protruding contact. Examples of this sort of terminal include female terminals. A female terminal includes a tubular portion into which a connector pin, a tab portion of a male terminal, or the like is inserted, and an elastic piece portion that is arranged inside the tubular portion and presses the tab portion or the like, and the top of the elastic piece portion is provided with a protruding contact. The protruding contact typically has the shape of a hemisphere face bulging toward the corresponding terminal. Furthermore, the protruding contact is formed by, for example, pressing a metal plate that has the plating film. Accordingly, if the plating film is arranged on the protruding contact, cracks can be suppressed from occurring in the plating film during pressing.

EXAMPLES

Example 1

Figure 2:
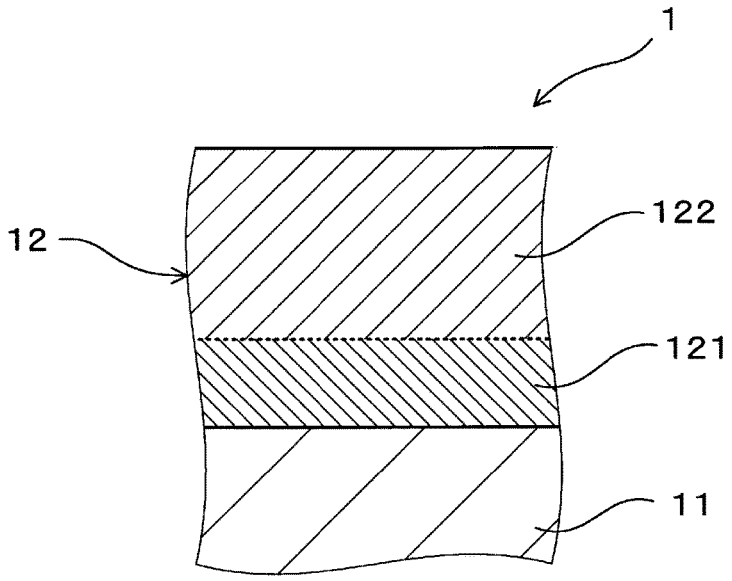
FIG. 2 is a partially enlarged cross-sectional view of a portion near a protruding contact in FIG. 1.

Hereinafter, examples of the metal plate and the terminal made from the metal plate will be described with reference to the drawings. A metal plate 1 of this example includes a base material 11 and a plating film 12 that covers the entire surface of the base material 11. As shown in FIG. 2, the plating film 12 includes an intermediate Ag layer 121 that is layered on the base material 11 and an Ag—Sn alloy layer 122 that is layered on the intermediate Ag layer 121 and exposed on the outermost surface.

Figure 1:
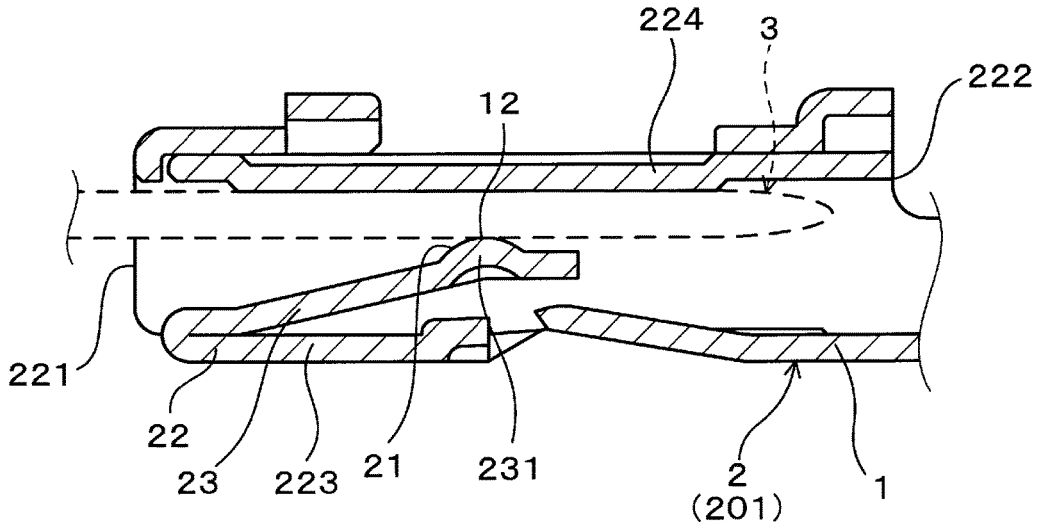
FIG. 1 is a partial cross-sectional view of a terminal in Example 1.

Furthermore, a terminal 2 of this example is made from the metal plate 1, and, as shown in FIG. 1, has a protruding contact 21 that comes into contact with a corresponding terminal 3. Furthermore, the plating film 12 is arranged at least on the protruding contact 21.

Hereinafter, detailed configurations of the metal plate 1 and the terminal 2 will be described with reference to their production methods.

The metal plate 1 of this example can be produced, for example, using the following method. First, an Ag plating film and an Sn plating film are sequentially layered on the entire surface of the base material 11 that has been degreased. The Ag plating film and the Sn plating film can be formed using a common method. The film thickness of the Ag plating film may be set as appropriate typically within a range of 1 to 3 μm. In order to form the intermediate Ag layer 121 through reflow treatment, which will be described later, the Sn plating film is preferably formed thinner than the Ag plating film. The film thickness of the Sn plating film may be set as appropriate within a range of, for example, 0.5 to 2 μm.

After the above-described plating film has been formed on the base material 11, reflow treatment for alloying Ag and Sn by heating the base material 11 in air is performed. The heating temperature in the reflow treatment may be set as appropriate within a range of, for example, 200 to 300° C. Furthermore, the heating time in the reflow treatment may be set as appropriate within a range of, for example, 10 to 180 seconds.

Through the reflow treatment, Ag and Sn are alloyed, and the Ag—Sn alloy layer 122 is formed on the outermost surface. At this time, Ag that has not reacted with Sn forms the intermediate Ag layer 121 between the base material 11 and the Ag—Sn alloy layer 122. Accordingly, the metal plate 1 shown in FIG. 2 can be obtained. Sn oxide and the like generated during the reflow treatment may be present on the outermost surface of the metal plate 1.

Note that the method for producing the metal plate 1 is not limited to the above-described method. For example, a method for sequentially forming the intermediate Ag layer 121 and the Ag—Sn alloy layer 122 on the base material 11 through electroplating may be used instead of the above-described method.

Then, the terminal 2 may be produced, for example, by performing punching, bending, and the like on the thus obtained metal plate 1. The terminal 2 may be configured, for example, as a female terminal 201 (see FIG. 1) for which a connector pin or a male terminal can be used as the corresponding terminal 3. The female terminal 201 is substantially in the shape of a bar, and includes a barrel portion (not shown) to which an electric wire can be connected and a tubular portion 22 that is continuous with the barrel portion.

The tubular portion 22 is substantially in the shape of an angular tube that is elongated in the longitudinal direction of the female terminal 201. An open end 221 on one side of the tubular portion 22 is open such that the corresponding terminal 3 can be inserted thereinto. Furthermore, an open end 222 on the other side is continuous with the barrel portion.

As shown in FIG. 1, an elastic piece portion 23 is provided inside the tubular portion 22. The elastic piece portion 23 is formed by bending a bottom plate portion 223 of the tubular portion 22 inward and rearward. Furthermore, the elastic piece portion 23 is configured such that the corresponding terminal 3 inserted into the tubular portion 22 is pressed toward a top plate portion 224 that faces the bottom plate portion 223.

A substantially center portion 231 in the longitudinal direction of the elastic piece portion 23 projects in the shape of a hemisphere toward the top plate portion 224, and its surface on the projecting side forms the protruding contact 21. The above-described plating film 12 is arranged on the protruding contact 21. When the corresponding terminal 3 is inserted into the tubular portion 22, the protruding contact 21 is pressed against the corresponding terminal 3 by the pressing force from the elastic piece portion 23. As a result, the Ag—Sn alloy layer 122 of the plating film 12 comes into contact with the corresponding terminal 3, and the female terminal 201 and the corresponding terminal 3 are electrically connected to each other.

The metal plate 1 of this example has the plating film 12 with the above-described specific layer configuration on the entire surface of the base material 11. Thus, when forming the metal plate 1 into the shape of the female terminal 201, cracks can be suppressed from occurring in the plating film 12 in the protruding contact 21, corners of the tubular portion 22, and the like. As a result, the terminal 2 produced from the metal plate 1 is excellent in terms of corrosion resistance and connection reliability.

Example 2

Figure 3:
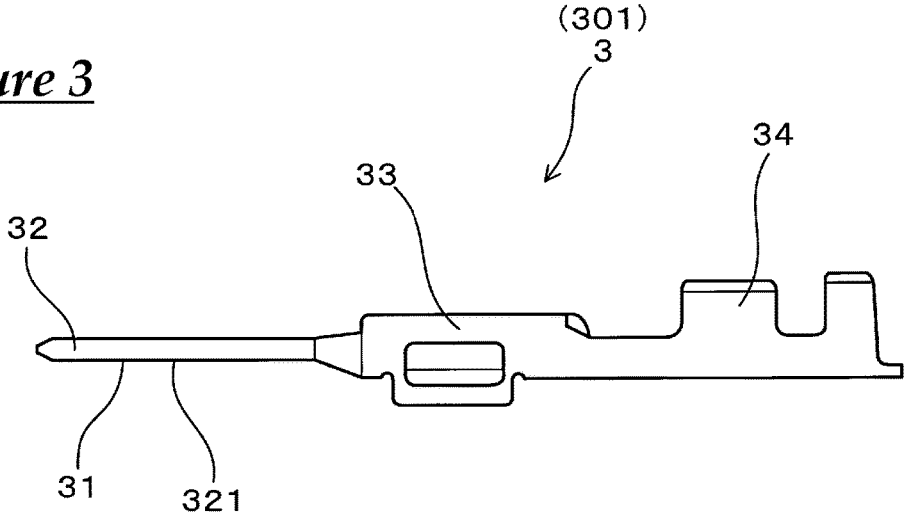
FIG. 3 is a side view of a corresponding terminal configured as a male terminal in Example 2.

This example is an example of a terminal pair formed of the terminal 2 and the corresponding terminal 3 that is fitted to the terminal 2. If one terminal of the terminal pair is the terminal 2 with the plating film 12, as shown in FIGS. 3 and 4, the corresponding terminal 3 preferably has a flat plate-shaped contact 31 that comes into contact with the protruding contact 21.

For example, the corresponding terminal 3 may be configured as a male terminal 301 (see FIG. 3) including a tab portion 32 that can be inserted into the tubular portion 22 (see FIG. 1) of the female terminal 201, a tubular portion 33 that is continuous with the tab portion 32, and a barrel portion 34 that is continuous with the tubular portion 33 and to which an electric wire can be connected. The male terminal 301 is substantially in the shape of a bar, and the tab portion 32, the tubular portion 33, and the barrel portion 34 are arranged in a row. The tab portion 32 starts from one open end of the tubular portion 33 and extends along the longitudinal direction of the male terminal 301. Furthermore, a cross-section of the tab portion 32 perpendicular to the longitudinal direction is flat. The flat plate-shaped contact 31 of the male terminal 301 is arranged at a flat portion 321 of the tab portion 32.

Figure 4:
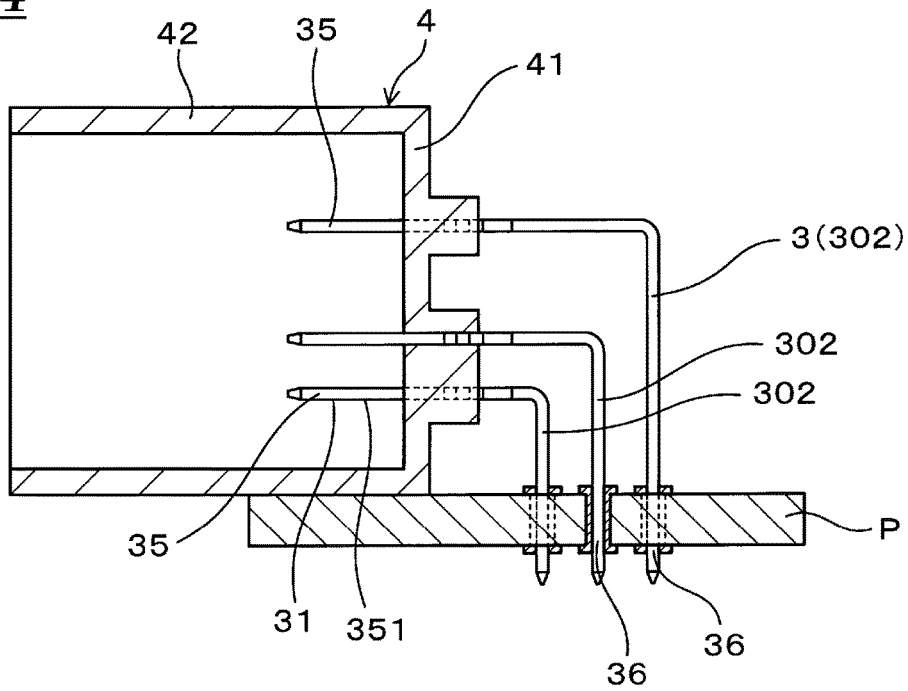
FIG. 4 is a cross-sectional view of a connector having a corresponding terminal configured as a connector pin in Example 2.

Furthermore, as shown in FIG. 4, the corresponding terminal 3 may be configured as a connector pin 302 held in a connector housing 4. The connector housing 4 includes a rear face wall 41 for holding connector pins 302, and a hood portion 42 provided standing upright from the outer peripheral edge of the rear face wall 41. The hood portion 42 is configured to internally accommodate a corresponding connector (not shown).

Each connector pin 302 is in the shape of an angular pin that passes through the rear face wall 41. An end of a connector pin 302 arranged inside the hood portion 42 forms a terminal connecting portion 35 that can be inserted into the tubular portion 22 (see FIG. 1) of the female terminal 201. Furthermore, an end of the connector pin 302 arranged outside the hood portion 42 forms a board connecting portion 36 that can be electrically connected to a printed circuit board P. The flat plate-shaped contact 31 of the connector pin 302 is arranged at a flat portion 351 of the terminal connecting portion 35.

Note that the corresponding terminal 3 is not limited to the male terminal 301 or the connector pin 302 described above, and may be configured as a terminal with a conventionally known form.

Figure 5:
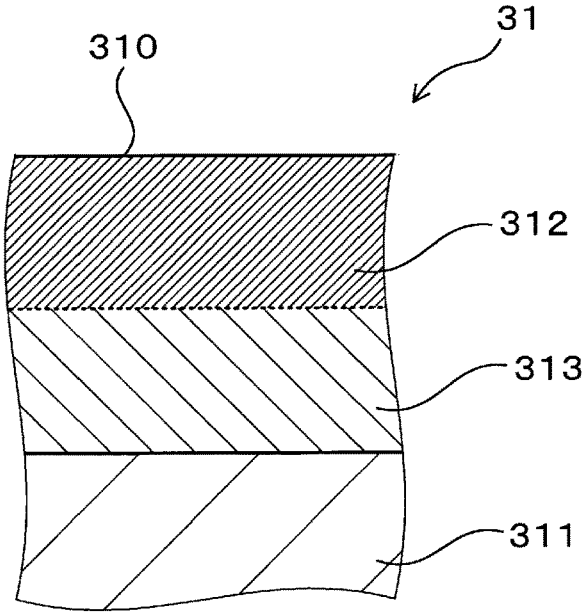
FIG. 5 is a partially enlarged cross-sectional view of a portion near a flat plate-shaped contact in Example 2.

As shown in FIG. 5, a surface Ag layer 312 is exposed on the outermost surface of the flat plate-shaped contact 31, that is, on a surface 310 that comes into contact with the protruding contact 21. The surface Ag layer 312 may be, for example, directly layered on a metal base material 311. Furthermore, a base layer 313 made of Ni, Cu, or an alloy containing these metals may be provided as necessary between the metal base material 311 and the surface Ag layer 312. The base layer 313 can achieve effects such as improving the degree of close contact between the metal base material 311 and the surface Ag layer 312 or suppressing the diffusion of metal elements from the metal base material 311 to the surface Ag layer 312. The surface Ag layer 312 and the base layer 313 can be formed, for example, using a conventionally known method such as electroplating.

When the thus configured corresponding terminal 3 is used in combination with the terminal 2, the wear resistance against micro-sliding can be improved compared with a terminal pair formed of the terminals 2 or a terminal pair formed of conventional terminals. Accordingly, the terminal pair can maintain low contact electrical resistance for a long period of time, for example, even in environments where harsh vibrations are applied as in automobiles.

Experimental Example 1

This example is an example where evaluation of the bendability was performed on metal plates in which various changes were made to the configuration of a metal layer on a base material. In this example, four types of metal plates (sample materials 1 to 4) described below were prepared.

Sample Material 1

A copper alloy plate with a thickness of 0.25 mm was prepared as a base material, and degreased and washed. Then, an Ag plating film with a film thickness of 2 μm and an Sn plating film with a film thickness of 1 μm were sequentially layered on the base material. Subsequently, reflow treatment was performed by heating the base material at a heating temperature of 300° C. for a heating time of 60 seconds, thereby obtaining a sample material 1. The sample material 1 had a plating film 12 in which an Ag layer 121 with a film thickness of 0.5 μm and an Ag—Sn alloy layer 122 with a film thickness of 3 μm were sequentially layered, on the base material 11.

Sample Material 2

A copper alloy plate with a thickness of 0.25 mm was prepared as a base material, and degreased and washed. Then, an Ni plating film with a film thickness of 1 μm, an Sn plating film with a film thickness of 1 μm, and an Ag plating film with a film thickness of 2 μm were sequentially layered on the base material. Subsequently, reflow treatment was performed by heating the base material at a heating temperature of 290° C. for a heating time of 60 seconds, thereby obtaining a sample material 2. The sample material 2 had a plating film in which an Ni layer with a film thickness of 1 μm, an Ni—Sn alloy layer with a film thickness of 0.5 μm, an Ag—Sn alloy layer with a film thickness of 1.5 μm, and an Ag layer with a film thickness of 1 μm were sequentially layered, on the base material.

Sample Material 3

A copper alloy plate with a thickness of 0.25 mm was prepared as a base material, and degreased and washed. Then, an Ni plating film with a film thickness of 1 μm, an Ag plating film with a film thickness of 2 μm, an Sn plating film with a film thickness of 2 μm, and an Ag plating film with a film thickness of 3 μm were sequentially layered on the base material. Subsequently, reflow treatment was performed by heating the base material at a heating temperature of 290° C. for a heating time of 60 seconds, thereby obtaining a sample material 3. The sample material 3 had a plating film in which an Ni layer with a film thickness of 1 μm, an Ag layer with a film thickness of 1 μm, an Ag—Sn alloy layer with a film thickness of 3.5 μm, and an Ag layer with a film thickness of 2 μm were sequentially layered, on the base material.

Sample Material 4

A copper alloy plate with a thickness of 0.25 mm was prepared as a base material, and degreased and washed. Then, an Ni plating film with a film thickness of 1 μm, an Ag plating film with a film thickness of 1.5 μm, and an Sn plating film with a film thickness of 0.5 μm were sequentially layered on the base material. Subsequently, reflow treatment was performed by heating the base material at a heating temperature of 290° C. for a heating time of 60 seconds, thereby obtaining a sample material 4. The sample material 4 had a plating film in which an Ni layer with a film thickness of 1 μm, an Ag layer with a film thickness of 0.5 μm, and an Ag—Sn alloy layer with a film thickness of 2 μm were sequentially layered, on the base material.

Figure 6:
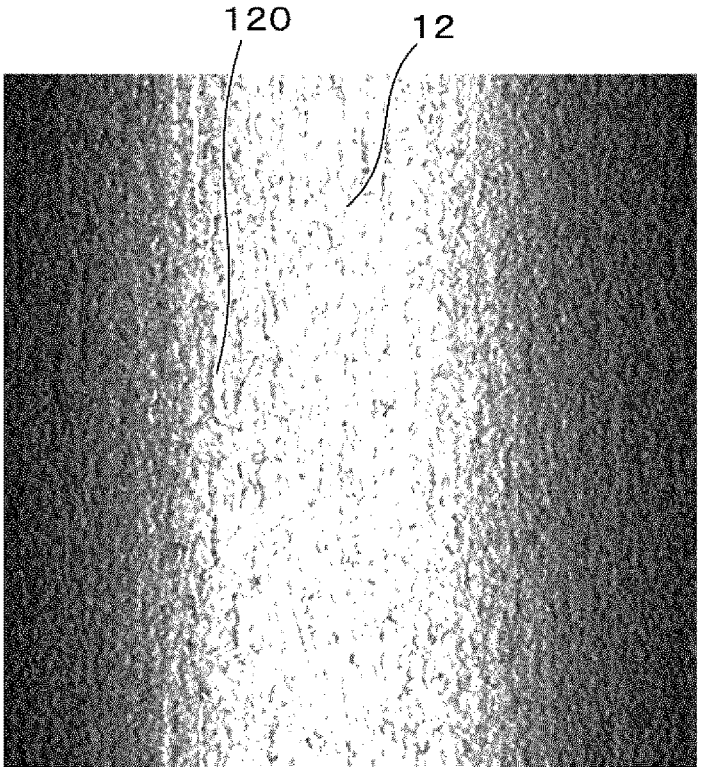
FIG. 6 is a photograph substituting a drawing showing a surface of a sample material 1 after completing a bending test in Experimental Example 1.
Figure 7:
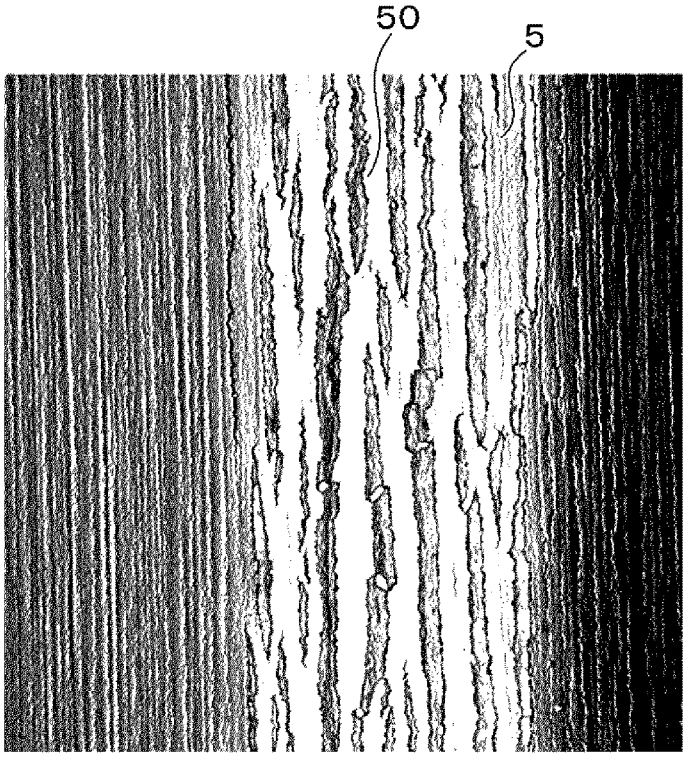
FIG. 7 is a photograph substituting a drawing showing a surface of a sample material 2 after completing the bending test in Experimental Example 1.
Figure 8:
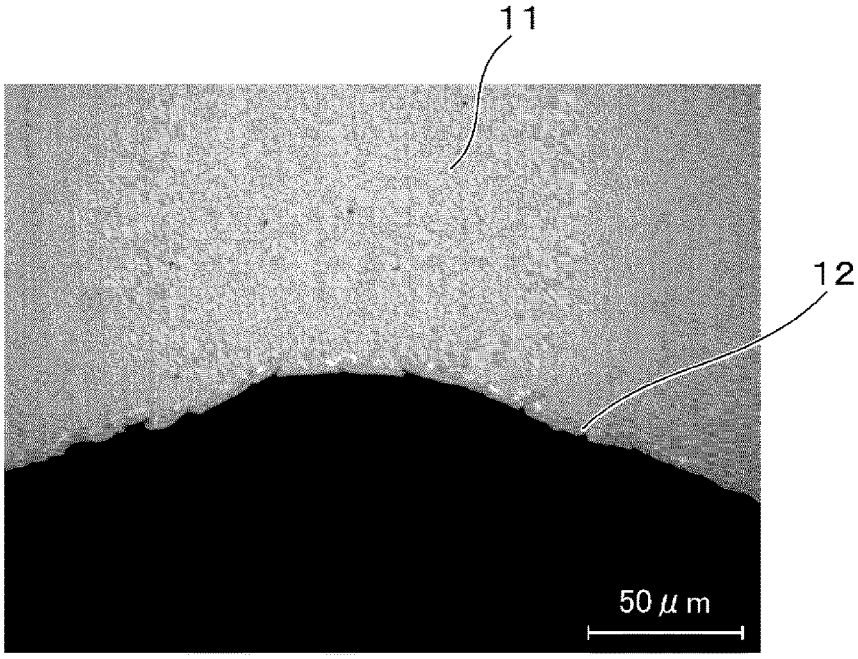
FIG. 8 is a photograph substituting a drawing showing a cross-section of the sample material 1 after completing the bending test in Experimental Example 1.
Figure 9:
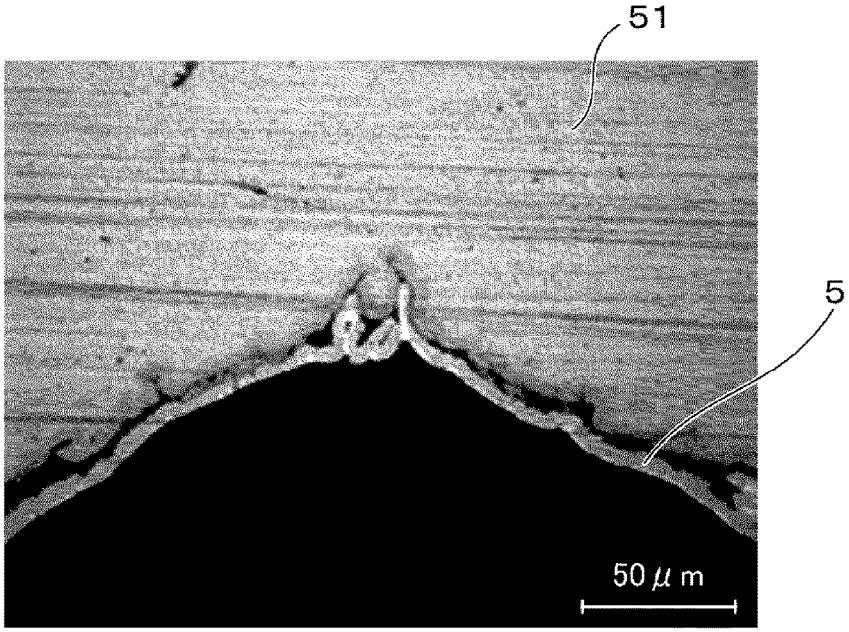
FIG. 9 is a photograph substituting a drawing showing a cross-section of the sample material 2 after completing the bending test in Experimental Example 1.

A 90-degree bending test was performed using the thus obtained sample materials 1 to 4. After the bending test was completed, the appearance on the external side of the bent portion was observed. FIGS. 6 and 7 show examples of this. Furthermore, after the bending test was completed, a cross-section of the internal side of the bent portion was observed. FIGS. 8 and 9 show examples of this.

It is seen from a comparison between FIGS. 6 and 7 that, in the sample material 1 in which an Ag layer and an Ag—Sn alloy layer were sequentially layered on the base material, a crack 120 in the plating film 12 after the bending test was relatively small (see FIG. 6). On the other hand, in the sample material 2 in which a relatively hard Ni layer and the like were arranged between the base material and the Ag—Sn alloy layer, a crack 50 in a plating film 5 after the bending test was larger than that in the sample material 1 (see FIG. 7). Furthermore, although not shown, also in the sample materials 3 and 4, a crack in the plating film after the bending test was larger than that in the sample material 1, as in the sample material 2.

Furthermore, it is seen from a comparison between FIGS. 8 and 9 that the sample material 1 kept the base material 11 and the plating film 12 in close contact after the bending test (see FIG. 8). On the other hand, in the sample material 2, the plating film 5 was separated from a base material 51 after the bending test (see FIG. 9). Furthermore, although not shown, also in the sample materials 3 and 4, a plating film separated from the base material after the bending test as in the sample material 2.

From the above-described results, it is seen that the sample material 1 is excellent in terms of bendability. In the sample material 1, for example, the plating film 12 can be easily prevented from cracking or separating during pressing to form the protruding contact 21 or during bending to form the female terminal 201.

Experimental Example 2

This example is an example where the evaluation of wear resistance under micro-sliding was performed on the sample materials of Experimental Example 1. In the evaluation of wear resistance, a movable test piece and a fixed test piece produced using the following procedure were used.

Movable Test Piece

The sample materials 1, 3, and 4 were cut into pieces each with a rectangular shape. The cut pieces were pressed to form embossed portions each in the shape of a hemisphere with a radius of 3 mm. Through the above-described processing, each movable test piece was produced. The movable test piece imitated the protruding contact 21 of the terminal 2 (the female terminal 201) in Example 1. Furthermore, no crack appeared in the plating film 12 arranged on the surface of the embossed portion.

Fixed Test Piece

The sample materials 1, 3, and 4 and a pure Ag plate were cut into pieces each with a rectangular shape, so that fixed test pieces in the shape of flat plates were obtained. The fixed test pieces each had a shape imitating the flat plate-shaped contact 31 of the corresponding terminal 3 (the male terminal 301) in Example 2.

Evaluation of Wear Resistance

Figure 10:
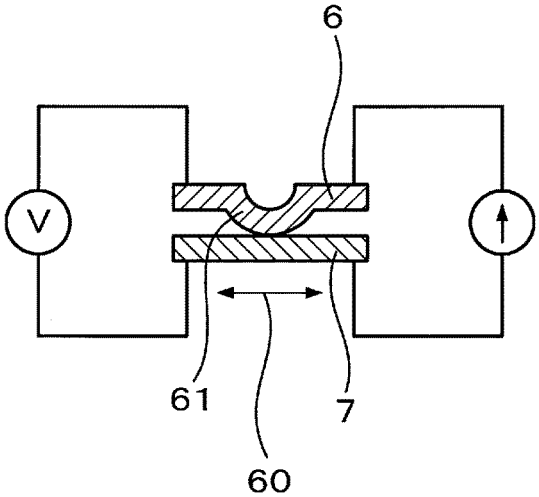
FIG. 10 is an explanatory diagram of a micro-sliding test in Experimental Example 2.

A movable test piece 6 and a fixed test piece 7 were laid over each other in the vertical direction, and an embossed portion 61 was brought into contact with the surface of the fixed test piece 7 (see FIG. 10). In this state, 3 N of a vertical load was applied to the movable test piece 6 using a piezo actuator, and the embossed portion 61 was pressed against the fixed test piece 7. In a state where this vertical load was maintained, the movable test piece 6 was vibrated in the horizontal direction (FIG. 10, arrow 60). Furthermore, when the movable test piece 6 was vibrated, the contact electrical resistance between the movable test piece 6 and the fixed test piece 7 was measured. The vibration cycle was set to 1 Hz, and the amplitude thereof was set to 200 μm.

When the movable test piece 6 had been vibrated for 2500 cycles, the test was ended. This test was performed while changing the combination of a movable test piece 6 and a fixed test piece 7 as shown in Table 1. The test was performed twice for each combination. Table 1 shows the maximum contact electrical resistances in the tests.

TABLE 1

| Combination | Movable test piece 6 | Fixed test piece 7 | Maximum contact electrical resistance (mΩ) 1st test | 2nd test |
|---|---|---|---|---|
| A | Sample material 1 | Pure Ag plate | 0.5 | 0.8 |
| B | Sample material 3 | Pure Ag plate | 1.2 | 1.8 |
| C | Sample material 4 | Pure Ag plate | 1.2 | 1.7 |
| D | Sample material 1 | Sample material 1 | ≥5 mΩ | ≥5 mΩ |
| E | Sample material 3 | Sample material 3 | ≥5 mΩ | ≥5 mΩ |
| F | Sample material 4 | Sample material 4 | ≥5 mΩ | ≥5 mΩ |

As seen from Table 1, in the combination A in which the movable test piece 6 was made of the sample material 1, and the fixed test piece 7 was made of a pure Ag plate, the maximum contact electrical resistance was 1 mΩ or less. On the other hand, in the combinations B and C in which the movable test piece 6 was made of the sample material 3 or 4, and the fixed test piece 7 was made of a pure Ag plate, the maximum contact electrical resistance was larger than that of the combination A.

It seems that, in the combination B, soft Ag is exposed on the surface of both the movable test piece 6 and the fixed test piece 7, and thus its coefficient of friction during sliding is larger than that of the combination A. Accordingly, it seems that the terminal insertion force of a terminal pair using the combination B is larger than that of a terminal pair using the combination A.

In the combinations D to F in which the movable test piece 6 and the fixed test piece 7 were made of the same sample material, the maximum contact electrical resistance was 5 mΩ or more.

From the above-described results, it is seen that the terminal pair in which the shape of a terminal contact and the configuration of metal layers provided on the contact surface are those specified as above is excellent in terms of wear resistance against micro-sliding, and low contact electrical resistance can be maintained for a long period of time.

It is to be understood that the foregoing is a description of one or more preferred exemplary embodiments of the invention. The invention is not limited to the particular embodiment(s) disclosed herein, but rather is defined solely by the claims below. Furthermore, the statements contained in the foregoing description relate to particular embodiments and are not to be construed as limitations on the scope of the invention or on the definition of terms used in the claims, except where a term or phrase is expressly defined above. Various other embodiments and various changes and modifications to the disclosed embodiment(s) will become apparent to those skilled in the art. All such other embodiments, changes, and modifications are intended to come within the scope of the appended claims.

As used in this specification and claims, the terms "for example," "e.g.," "for instance," "such as," and "like," and the verbs "comprising," "having," "including," and their other verb forms, when used in conjunction with a listing of one or more components or other items, are each to be construed as open-ended, meaning that the listing is not to be considered as excluding other, additional components or items. Other terms are to be construed using their broadest reasonable meaning unless they are used in a context that requires a different interpretation.

The invention claimed is:

1. A terminal pair having a terminal and a corresponding terminal that is fitted to the terminal, the terminal includes a metal plate that comprises:

a base material; and a plating film that covers at least part of the base material, the plating film includes:

an intermediate Ag layer that is layered on the base material, and an Ag—Sn alloy layer that is layered on the intermediate Ag layer and is exposed on an outermost surface, wherein a thickness of the intermediate Ag layer is smaller than a thickness of the Ag—Sn alloy layer, wherein the terminal has a protruding contact that comes into contact with the corresponding terminal, the plating film is arranged at least on the protruding contact, wherein the corresponding terminal has a flat plate-shaped contact that comes into contact with the protruding contact of the terminal, and wherein the flat plate-shaped contact has a surface Ag layer that is exposed on an outermost surface.

2. The terminal pair according to claim 1, wherein the thickness of the intermediate Ag layer is 0.3 μm or more.

* * * * *